United States Patent [19]

Laure et al.

[11] Patent Number: 4,717,027

[45] Date of Patent: Jan. 5, 1988

[54] VIBRATORY BELT SEPARATOR FOR BLOW-MOLDED PARTS

[75] Inventors: George R. Laure; Brett M. Canter, both of Kalamazoo, Mich.

[73] Assignee: LaRos Equipment Company, Inc., Portage, Mich.

[21] Appl. No.: 845,905

[22] Filed: Mar. 28, 1986

[51] Int. Cl.[4] ..... B07C 5/04

[52] U.S. Cl. ..... 209/620; 209/665; 198/631

[58] Field of Search ..... 209/522, 620, 621, 622, 209/665, 668, 681, 923; 198/631, 817

[56] References Cited

U.S. PATENT DOCUMENTS

| | | | |
|---|---|---|---|
| 937,213 | 1/1909 | Hough | 209/3 |
| 1,011,444 | 12/1911 | Kihlgren | 198/631 |
| 1,322,877 | 10/1918 | Lee et al. | 177/22 |
| 1,552,366 | 3/1925 | Wade | 209/924 |
| 1,565,623 | 12/1925 | Cassie | 209/620 X |
| 2,054,247 | 9/1936 | Dilger et al. | 198/384 X |
| 2,350,691 | 9/1940 | Mauroner | 209/620 |
| 3,115,169 | 5/1962 | Rodriguez | 83/155 |
| 3,150,022 | 1/1961 | Vida | 209/307 |
| 3,653,509 | 12/1969 | Goodman | 209/540 |
| 3,704,780 | 6/1971 | Aidlin et al. | 209/678 |
| 3,713,537 | 8/1970 | Walker | 209/665 |
| 3,770,111 | 5/1972 | Greenwood et al. | 209/580 |
| 3,779,379 | 12/1973 | Buchbinder et al. | 209/620 X |
| 4,300,895 | 11/1981 | Meenen | 198/631 X |
| 4,470,591 | 9/1984 | Acquaviva | 198/817 X |
| 4,535,894 | 1/1983 | Shell | 209/665 |
| 4,593,821 | 4/1985 | Brule | 209/620 |
| 4,601,132 | 1/1985 | Stahl | 198/842 |

FOREIGN PATENT DOCUMENTS

| | | |
|---|---|---|
| 332927 | 7/1930 | United Kingdom . |
| 729927 | 5/1955 | United Kingdom . |
| 635913 | 5/1978 | U.S.S.R. . |

*Primary Examiner*—Robert B. Reeves
*Assistant Examiner*—Glenn B. Foster
*Attorney, Agent, or Firm*—Flynn, Thiel, Boutell & Tanis

[57] ABSTRACT

A separator for blow-molded parts, which separator includes a plurality of endless belts movably supported between a pair of horizontally spaced pulleys, one of which is a drive pulley. The belts, preferably of circular cross section, have upper reaches extending in approximately parallel but sidewardly spaced relationship to define small gaps therebetween through which scrap parts can pass. The other parts remain on the belt and are transported to a discharge location. The adjacent belts are preferably driven at slightly different speeds to facilitate agitation and dislodgement of scrap parts so that they can move into and through the gaps. The ends of the belts are supported by rotatable end idler pulleys, alternate ones of which preferably have exterior belt-engaging profiles which are noncircular relative to the rotational axis to effect cyclic vertical displacement of the upper reaches of alternate belts.

15 Claims, 9 Drawing Figures

VIBRATORY BELT SEPARATOR FOR BLOW-MOLDED PARTS

FIELD OF THE INVENTION

This invention relates to a belt-type separator apparatus for effecting separation of different sized or shaped parts and, more particularly, to an apparatus for effecting separation of blow-molded bottles from the moils and tails.

BACKGROUND OF THE INVENTION

In the blow-molding of bottles or similar containers, the blow-molding operation results in the formation of a "tail" at the closed end of the bottle, which tail must be snapped off, this generally being accomplished during removal of the bottle from the blow-molding machine. The blow-molding operation also results in the formation of a ringlike collar (known in the trade as a "moil") around the opening to the bottle, which moil is cut off from the molded bottle substantially upon completion of the molding operation. The blow-molded bottles, tails and moils are then generally discharged from the blow-molding machine into a separator to effect separation of the bottles from the moils and tails, which latter components are scrap plastic and can be recycled.

While separation of the moils and tails from the bottles has been a long-standing problem in the blow-molding industry, nevertheless there has been developed a belt separator which has proven highly desirable and efficient for effecting this separation, such belt separator being disclosed in now U.S. Pat. No. 4,593,821, filed April 25, 1985, now U.S. Pat. No. 4,593,821 which application is owned by the assignee of this invention. The disclosure of U.S. Pat. No. 4,593,821, in its entirety, is incorporated herein by reference.

The belt separator disclosed in aforementioned U.S. Pat. No. 4,593,821 discloses a plurality of narrow (preferably round) endless belts disposed in spaced side-by-side relationship, with the upper reaches of adjacent belts being driven by different diameter drive pulleys so that the upper reaches move at slightly different speeds. In addition, the lower reaches are controlled by idler pulleys so that the upper and lower reaches are disposed in close proximity to one another. With this arrangement, it has been discovered that, with a significant number of different shapes and sizes of bottles, effective separation of the bottles can be achieved by carrying the bottles along the belts, with the moils and tails being effectively discharged downwardly between the belts.

Even though the belt separator of the aforementioned application has proven desirable in many use applications, nevertheless it has been observed that less than optimum performance is achieved when this known separator is used with bottles having a certain size and/or shape in relationship to the size or configuration of the moils and tails. For example, when separate bottles having an oval cross-sectional size similar to the size of the moil, it has been observed that the bottles can in some instances move partially downwardly between the belts so that the bottles become trapped between the upper and lower belt reaches. This sometimes requires a momentary shut-down of the separator to effect clearance of the trapped bottles from the belts, and this can undesirably reduce the efficiency and effectiveness of the separation operation.

The present invention relates to a belt separator of the general type disclosed in the aforementioned application, but more specifically is directed to an improvement in said belt separator so as to permit the separator to effect both a rapid and a highly efficient separation of the bottles from the moils and tails, with this separation being capable of performance with an even wider range of sizes and/or shapes of bottles in relationship to the moils and tails, and specifically permitting effective separation of oval bottles from similarly sized moils. The improved separator of this invention in particular has been observed to be more effective in providing the desired separation, and more effective in avoiding trapping of bottles between the upper and lower belt reaches.

In the improved belt separator of this invention, there is employed a plurality of narrow, preferably round, endless belts disposed with the upper reaches thereof in closely adjacent but slightly spaced side-by-side relationship. The adjacent belts are preferably driven at slightly different speeds to effect twisting movement of the bottles and parts which are deposited on the adjacent belts. The endless belts, at the end opposite the drive pulleys, pass over idler pulleys, some of which are designed to function as a vibratory means to cause the upper reaches of some belts to be vertically vibrated or bounced. The vertical vibration of one upper belt reach of each adjacent pair is believed to significantly improve the separating efficiency and at the same time minimize the trapping of bottles between the upper and lower belt reaches, particularly by causing substantially automatic dislodgement of any bottles which have a tendency to be so trapped.

With the improved belt separator of this invention, the vibration of the upper belts is preferably achieved by forming alternate end idler pulleys of a noncircular cross section, with the intermediate end idler pulleys having a circular cross section. The end idler pulleys are all preferably individually freely rotatably supported on an end idler shaft, and the noncircular end idler pulleys preferably have an elongated cross section formed by a pair of lobes which project outwardly in opposite direction so as to achieve the desired vertical vibration of the upper belt reach in response to rotation of the end idler pulleys. In the preferred embodiment, the noncircular end idler pulleys are effectively formed by rectangular blocks which have a length dimension which exceeds the width dimension, with the corners of the blocks being appropriately rounded.

Other objects, purposes and advantages associated with the improved belt separator of the present invention will be apparent to persons familiar with apparatus of this general type upon reading the following specification and inspecting the accompanying drawings.

Figures 1, 3, 7, 8:
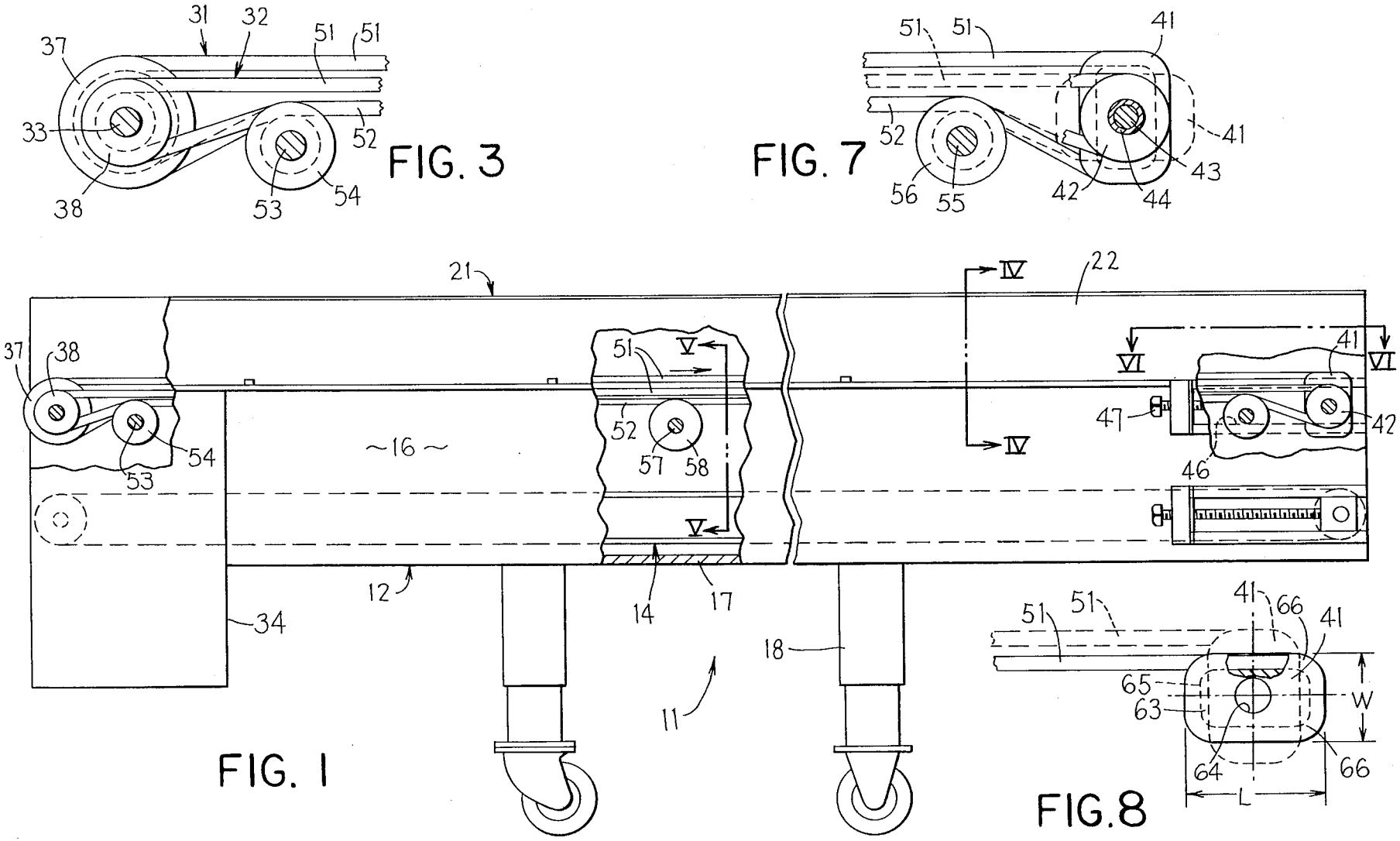
FIG. 1 is a side elevational view of the improved separator apparatus of this invention.
FIG. 3 is an enlarged fragmentary view showing the drive pulleys for the belts.
FIG. 7 is a fragmentary sectional view taken substantially along line VII—VII in FIG. 6.
FIG. 8 is a side view illustrating one of the end idler pulleys in both a solid and dotted-line position so as to indicate the manner in which it vibrates the upper belt reach during the pulley rotation.
Figure 2:
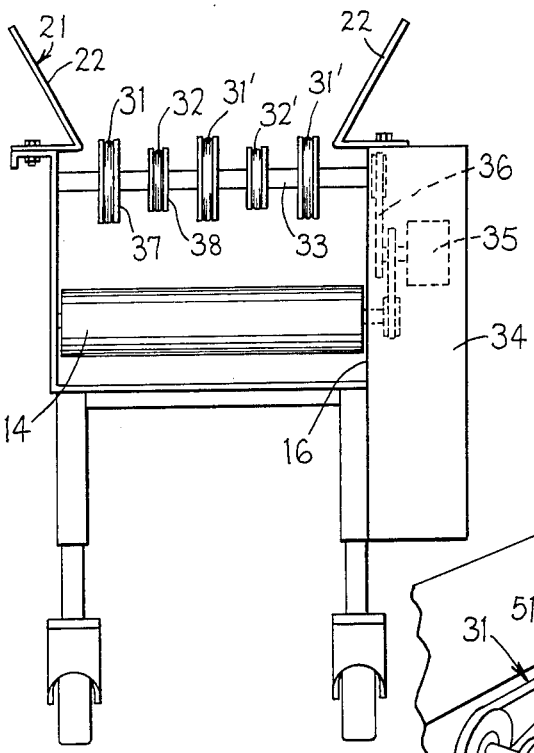
FIG. 2 is a left end elevational view of FIG. 1.

Certain terminology will be used in the following description for convenience in reference only, and will not be limiting. For example, the words "upwardly", "downwardly", "leftwardly" and "rightwardly" will refer to directions in the drawings to which reference is made. The word "forwardly" will refer to the normal direction of movement of parts, specifically bottles, along the upper belt reaches, which "forward" movement is from left to right in FIG. 1. The words "inwardly" and "outwardly" will refer to directions in the drawings to which reference is made. Said terminology will include the words specifically mentioned, derivatives thereof, and words of similar import.

DETAILED DESCRIPTION

Referring to the drawings, there is illustrated an apparatus 11 which is particularly desirable for effecting separation of blow-molded parts. In this regard, reference is made to FIG. 9 which illustrates several different blow-molded parts supported on the apparatus 11. The blow-molded parts include a conventional blow-molded bottle or container 1, a "tail" 2 which is formed integral with and projects outwardly from the bottom wall of the container, which tail is snapped off from the container, and a "moil" 3 which is the ring of excess plastic material which is cut from the mouth of the bottle 1. The tail 2 and moil 3 are scrap parts which must be separated from the bottles 1, which scrap parts can then be recycled. These moils and tails will hereinafter be referred to solely as the scrap parts for purposes of distinguishing them from the containers 1.

The separator apparatus 11 includes a housing 12 which supports thereon a belt means 13 for effecting separation between the containers 1 and the scrap parts 2,3. A conveyor belt arrangement 14 is positioned below the belt means 13 for collecting and discharging the scrap parts. This conveyor belt arrangement 14 is described in detail in aforementioned application Ser. No. 726 861, so that a description thereof is incorporated herein by reference.

The housing 12 generally resembles an elongated upwardly opening box and is formed by a pair of substantially parallel upright sidewalls 16 joined together by a bottom wall 17. The housing 12 is supported by a plurality of legs 18 which are preferably vertically adjustable and provided with rollers to facilitate adjustment and movement of the apparatus for convenience of use.

To permit the mixture of molded parts 1–3 to be supplied to the apparatus, the housing mounts thereabove a substantially V-shaped chute structure 21 which is elongated substantially longitudinally of the housing. This chute structure 21 includes a pair of opposed side rails 22 which extend longitudinally of the housing and are disposed adjacent the opposite sides thereof. These side rails 22 project upwardly of the housing and are inclined outwardly in opposite directions relative to the vertical. Side rails 22 at their lower longitudinally extending edges are hinged at 23 to respective substantially horizontal support plates 24, which plates project sidewardly of the housing. These support plates 24 are slidably supported on substantially horizontal top flanges 19 which are fixed to and project outwardly from the upper edges of the housing sidewalls 16. The support plates have elongated sidewardly extending slots 25 at several longitudinally spaced locations, and appropriate threaded fasteners 26 extend through slots 25 for securement to the underlying flanges 19. This enables the rails 22 to be adjustably moved inwardly and outwardly relative to the housing and then secured in the selected position, thereby varying the width of the discharge gap 29 as located between the lower longitudinally extending parallel edges of the side rails 22. The mixture of parts is fed downwardly into this gap 29 due to the converging chutelike region 28 defined between the side rails 22.

The discharge gap 29 at the lower end of the chute structure 21 extends longitudinally along the housing and is positioned directly over the belt means 13 for permitting the mixture of blow-molded parts to be supplied thereto. This belt means 13 preferably includes at least two endless belts 31 and 32 positioned in adjacent side-by-side relationship. In the illustrated embodiment, the belt means 13 is provided with five belts positioned in side-by-side relationship, the additional belts being respectively identical to and identified as the belts 31' and 32'. All of these belts are effectively positioned within parallel vertical planes which are disposed closely adjacent one another and extend longitudinally of the housing.

In the following description, the structure and operation of solely the belt pair 31–32 will be described. It will be understood that this structure and operational description will be equally applicable to the other cooperating belt pairs.

To effect driving of the belts 31–32, there is provided a drive shaft 33 which extends transversely between the sidewalls of the housing adjacent one end thereof. This drive shaft 33, which extends substantially horizontally, is rotatably supported on the housing and has one end thereof projecting sidewardly through one of the housing sidewalls into a control housing 34. A variable speed motor 35 is disposed within this control housing and is connected by an intermediate drive transmitting means 36, such as a chain drive, to a pulley mounted on the end of the shaft 33 for effecting rotation thereof. First and second drive pulleys 37 and 38 are nonrotatably secured to the drive shaft 33 in closely adjacent but axially spaced relationship. These drive pulleys 37 and 38 are individually nonrotatably secured to the shaft 33, as by a set screw arrangement. The first drive pulley 37 preferably has a diameter which is greater than the diameter of the second drive pulley 38, the purpose of this diameter differential being explained hereinafter.

The drive pulleys 37 and 38 respectively support and drivingly engage the belts 31 and 32 at one end thereof, and the other ends of these belts are respectively supported by individual end idler pulleys 41 and 42 which are individually rotatably supported on a shaft 43. The spacing between the adjacent idler pulleys 41 and 42 is maintained by spacer sleeves 44 which surround the shaft 43. This shaft 43 extends transversely of the housing adjacent the other end thereof, with the shaft being mounted on a yokelike support block (not shown), this latter block being linearly slidably supported by elongated guides or grooves 46 which extend in the longitudinal direction of the housing. An adjustable locating means 47, such as as threaded shaft, is coupled between the housing and the support block so as to adjust the position of the idler pulleys 41 and 42. This permits the idler pulleys to be moved inwardly when mounting or replacement of a belt is desired, and additionally permits the shaft to be selectively positioned so as to properly tension the belts.

Due to the manner in which the belts 31 and 32 extend between the driving pulleys 37–38 and the end idler pulleys 41–42, each individual belt has elongated upper and lower belt reaches 51 and 52, respectively extending longitudinally throughout the housing of the separator, with the respective upper and lower belt reaches 51 and 52 of each belt being appropriately vertically spaced.

Adjacent the driving ends of the belts, there is provided a lower idler shaft 53 which extends transversely across the housing in close proximity to and substantially parallel to the drive shaft 33. A plurality of axially adjacent identical lower idler pulleys 54 are individually rotatably supported on this shaft 53, which pulleys in their entirety are disposed below but individually maintained in supported engagement with a lower belt reach 52 of one of the belts 31, 32, 31' and 32'.

In addition to the lower idler pulleys 54 disposed adjacent the driving pulley 37 and 38, there is additionally provided a further plurality of lower idler pulleys 56 which are individually rotatably supported on a transverse shaft 55, the latter being disposed closely adjacent the other end of the housing in close proximity to the end idler pulleys 41–42. The lower idler pulleys 54 and 56 are preferably supported at elevations such that their engagement with the lower belt reaches 52 results in these lower belt reaches 52 being deflected upwardly relative to the adjacent driving and end idler pulleys. The lower belt reaches 52 are thus positioned approximately parallel to and closely adjacent the respective upper belt reaches 51, but are disposed downwardly therefrom by a small clearance distance which is preferably no more than about one-half inch in most instances. This positioning of the upper and lower belt reaches closely adjacent one another in direct overlying relationship prevents the creation of any significant gaps between the upper and lower belt reaches, and this tends to minimize the tendency of bottles or scrap parts being caught or trapped therebetween.

The end idler pulleys 42 are disposed alternately between the pulleys 41. The pulleys 42 are preferably of circular profile about their rotational axis.

At a location disposed approximately midway between the opposite ends of the housing, there is provided a further support shaft 57 which extends transversely across the housing at a location disposed below the lower belt reaches 52. This shaft 57 supports a plurality of guide pulleys 58, the latter being individually rotatably supported. Each of these guide pulleys 58 has a deep annular groove 59 formed therein for loosely guidably accommodating therein a respective one of the lower belt reaches 52. This groove 59 is of substantial depth so as to prevent undesired sideward displacement of the lower belt reach, while at the same time accommodating at least limited vertical displacement or vibration of the lower belt reach as caused by the operation of the apparatus.

The idler or guide pulleys 54, 56 and 58 are preferably free to float or move axially relative to their respective shafts so as to accommodate and adjust to the selected spacings between the belts.

The belts 31 and 32 preferably have a rounded or circular cross section, such as about one-fourth to one-half inch in diameter, and are normally constructed of an elastomeric material, namely a plastic material such as polyurethane.

To impose a vertical vibration onto the upper belt reaches 51, the end idler pulleys 41 are provided with a noncircular cross section so as to effectively function as a vibrator structure for causing the respective upper belt reaches 51 to be vertically vibrated. For this purpose, each idler pulley 41 is preferably provided with a noncircular cross section which, as illustrated by FIGS. 7 and 8, is elongated in one direction so as to define a pair of outwardly projecting lobes, which lobes are disposed so as to project outwardly in diametrically opposite directions so that each idler pulley 41 has an elongated cross section and a transverse shorter cross section so as to effect raising and lowering of the respective upper belt reach 51 as the end idler pulley 41 rotates. By providing each end idler pulley 41 with two such lobes, the respective upper belt reach 51 undergoes two vertical oscillation or vibration cycles for each rotation of the end idler pulley.

In a preferred embodiment, the end idler pulley 41 is preferably provided with a substantially rectangular cross section as defined by a substantially rectangular block 63 as illustrated in FIG. 8, this block having a central hole 64 therethrough for rotatably accommodating the support shaft 43. This block 63 has an annular groove 66 around the periphery thereof for accommodating therein the respective belt. The corners 66 of this block are preferably rounded to eliminate any sharp or severely abrupt belt curvatures. The block 63 preferably has a length L in one dimension and a width W in the perpendicular direction, with the length L significantly exceeding the width W. For example, in a preferred embodiment, a length L of four inches and a width W of three inches has been experimentally observed to provide a desirable performance. The corners 66 are preferably provided with a radius of about one inch.

The length L preferably exceeds the width W by about 25% to about 50%.

The end idler pulleys 41 could, as an alternate shape, be of an oval or elliptical configuration.

OPERATION

The operation of the separator apparatus 11 will be briefly described to ensure complete understanding thereof.

The motor 35 causes rotation of the driving pulleys 37–38, which pulleys cause the upper belt reaches 51 to move substantially horizontally forwardly in the direction indicated by the arrow in FIG. 1. Since the first drive pulley 37 is of larger diameter than the second drive pulley 38, this causes the first belt 31 to move at a linear speed or velocity which is greater than the linear speed of the second belt 32, the difference being in proportion to the difference in diameter between the pulleys 37–38. For this purpose, the diameter of pulley 37 is preferably at least 10% greater than the diameter of pulley 38 so that the speed of belt 31 will be at least 10% greater than the speed of the belt 32. The ratio between the diameters of pulleys 37–38 can be as much as 3:1, thus resulting in a 3:1 speed ratio between the belts 31–32. A more preferable speed ratio is preferably in the range of from about 5:4 to about 2:1 so as to provide belt 31 with a linear velocity from about 25% to about 100% greater than the linear velocity of belt 32. In a preferred embodiment, the drive pulleys 37 have a diameter of about 4½ inches, and the drive pulleys 38 have a diameter of about 2½ inches.

When the mixture of molded parts 1–3 is deposited into the chute structure 21, the parts are funneled downwardly through the chute to the discharge gap 29 for engagement with the linearly moving belts. The transverse spaces or gaps 61 between the adjacent belts, and between the sidewardmost belts and the lower edges of the rails 22, are smaller than the minimum dimension of the bottles or containers 1. The bottles can thus not pass easily downwardly between the belts, but instead remain on the belts and are transported longitudinally along the apparatus for discharge at one end thereof, namely the rightward end in FIG. 1. During this transport of the bottles longitudinally through the apparatus, it has been observed that the differential velocity between adjacent side-by-side belts causes a turning of the bottles so that they tend to longitudinally align themselves in the longitudinal direction of the apparatus.

Figure 9:
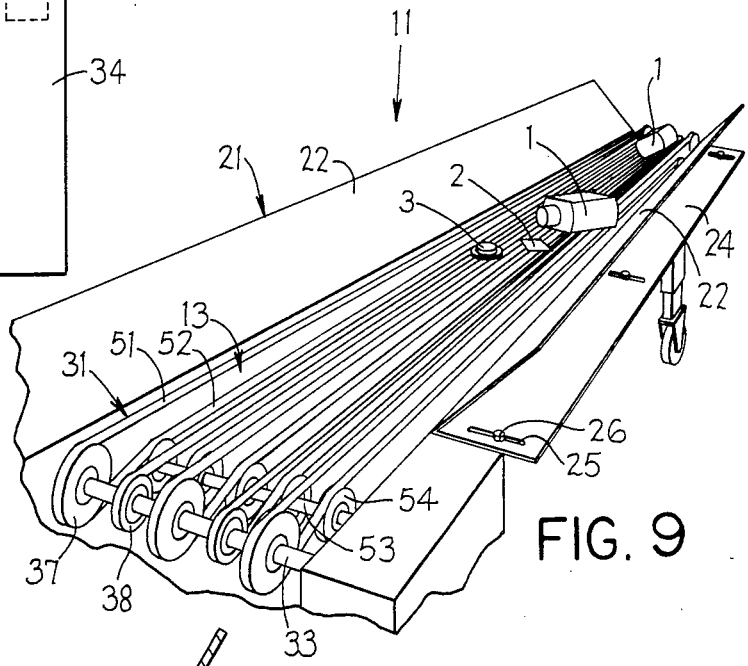
FIG. 9 is a perspective view of the belt separator apparatus.
Figure 4:
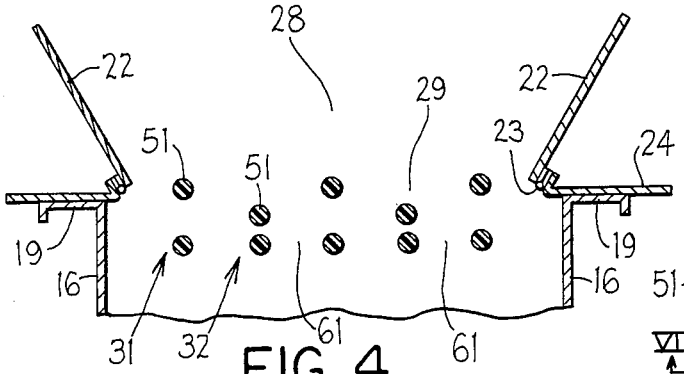
FIG. 4 is an enlarged fragmentary sectional view taken substantially along line IV—IV in FIG. 1.
Figure 6:
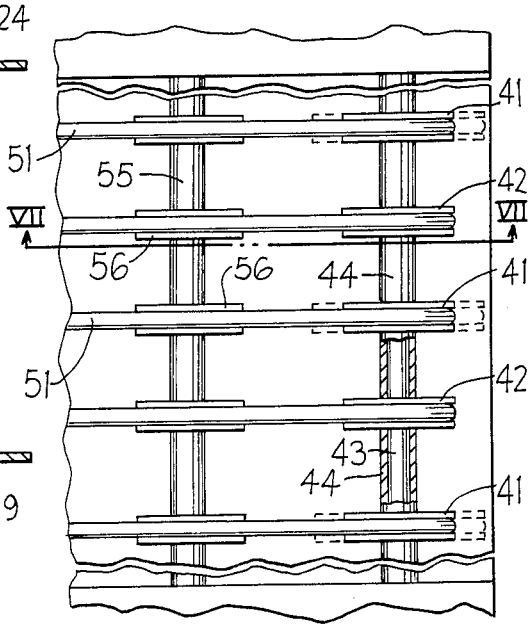
FIG. 6 is a fragmentary top view taken substantially along line VI—VI in FIG. 1.
Figure 5:
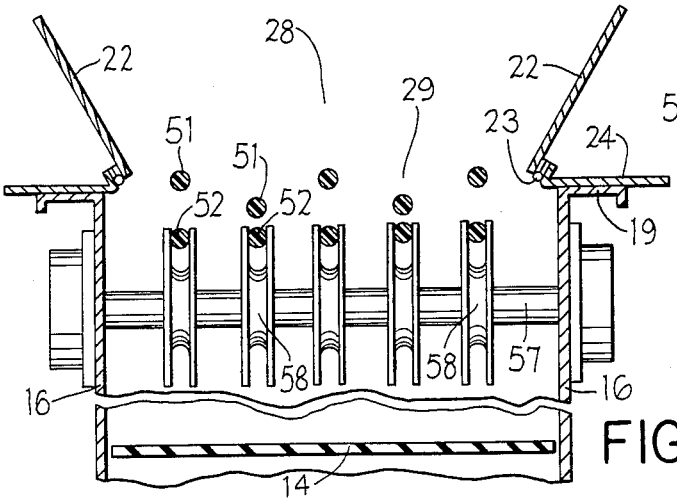
FIG. 5 is an enlarged fragmentary sectional view taken substantially along line V—V in FIG. 1.

With respect to the smaller tails 2 and moils 3, some of these will readily fall downwardly through the spaces 61 for deposit on the underlying conveyor belt 14. However, the tails and moils generally have a dimension within at least one plane or direction which is greater than the transverse width of the spaces 61. Some of the tails and moils will initially straddle the upper reaches 51 of two adjacent belts as illustrated in FIG. 9. However, due to the speed differential between the upper reaches of each adjacent pair of belts, this speed differential causes the parts 2–3 which straddle adjacent belts to effectively rotate within the horizontal plane defined by the upper contact surfaces of the belts. As the scrap parts are rotated due to the belt speed differential, this also results in some sideward displacement of the parts until they lose engagement with at least one of the belts and fall into and through the spaces 61.

In addition to the differential velocity between the upper belt reaches, the vibration imposed on the alternate upper belt reaches by the end idler pulleys 41 is also highly effective in facilitating the effective separation between the bottles 1 and scrap parts 2–3. More specifically, due to the rotation of the noncircular idler pulleys 41, one of the upper reaches 51 of each adjacent pair of belts will hence be vibrated upwardly and downwardly in a cyclic manner. This causes a sufficient vibration of the bottles and parts to accelerate the displacement of the parts 2–3 so that they are moved from any straddling position and hence readily fall into and through the gaps 61 for deposit on the conveyor 14.

In addition to the improved separating effect achieved by the vibration of the belts, this vibration also results in some of the upper reaches 51 being relatively moved into a slightly skewed relationship with respect to the respective lower belt reaches, and hence if the bottles have a tendency to slip downwardly and become trapped between the upper and lower belt reach, then this vibration greatly assists in dislodging the trapped bottles from between the belt reaches and permits the trapped bottles to fall downwardly through the gaps 61 so as to be recycled with the scrap parts.

Since the elongated upper reaches of the elastic belts 31 and 32 are tensioned as they stretch between the end pulleys, this in itself tends to create a small amplitude vibration as the belts move between the end pulleys, which vibration is further emphasized by the noncircular end idler pulleys 41, whereby substantial agitation of the scrap parts is achieved so as to accelerate their alignment with and deposit into the gaps 61.

The vibration of the alternate upper belt reaches adjacent the end idler pulleys 41 results in the upper belt reaches of adjacent belts assuming a variable staggered relationship. In addition, these upper belt reaches adjacent the driving pulleys 37–38 are also staggered due to the different diameters of the driving pulleys. These staggered relationships between adjacent belts further accelerates the agitation of the scrap parts so as to facilitate their deposit into the gaps 61.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A separator apparatus for effecting separation of a mixture of parts, such as blow-molded plastic parts, comprising:

a housing means;

elongated separator belt means movably mounted on said housing means for effecting separation of a mixture of parts by permitting first parts to fall therethrough while supporting second parts and transporting them to a discharge location;

said separator means including at least two narrow endless belts movably supported on the housing means, said belts having elongated upper belt reaches which extend approximately horizontally along the length of the housing means, said upper belt reaches extending in approximately parallel and adjacent side-by-side relationship and being provided with a small predetermined clearance space therebetween through which said first parts can pass;

drive means for moving said belts relative to said housing means, said drive means including drive pulley means engaging said belts adjacent one end thereof;

end idler pulleys rotatably supported adjacent and disposed in supportive engagement with said belts adjacent the other end thereof; and means for effecting cyclic vertical vibration of the upper reach of at least one said belt relative to an adjacent said belt, said last-mentioned means including a said end idler pulley which is disposed in supportive engagement with said one belt, said one end idler pulley having a noncircular peripheral profile relative to its axis of rotation for effecting cyclic vertical vibration of the upper reach of said one belt.

2. An apparatus according to claim 1, wherein said adjacent belt is disposed in supportive engagement with an adjacent said end idler pulley which is of circular peripheral profile relative to its axis of rotation so that it does not effect any vertical vibration of the upper belt reach of said adjacent belt.

3. An apparatus according to claim 2, including lower idler pulley means supported for rotation and disposed in supportive engagement with the lower belt reaches of said endless belts for deflecting the lower belt reaches upwardly to maintain them in closely adjacent but slightly downwardly vertically spaced relationship with respect to the respective upper belt reaches.

4. An apparatus according to claim 3, wherein said one end idler pulley as disposed in engagement with said one belt is elongated in one direction so as to define a pair of lobes which project outwardly in opposite directions to cause two cycles of vertical vibration of the respective upper belt reach during each rotation of the one end idler pulley.

5. An apparatus according to claim 4, wherein said drive pulley means include one drive pulley disposed in driving engagement with said one belt and an adjacent drive pulley disposed in driving engagement with said adjacent belt, said one and adjacent drive pulleys being rotatably driven at the same speed, and said one drive pulley being of greater diameter than said adjacent drive pulley.

6. An apparatus according to claim 4, including a plurality of adjacent rotatably supported guide pulleys positioned below the lower belt reaches for respective supportive engagement with a respective one of said lower belt reaches, said guide pulleys being disposed for supportive engagement with said lower belt reaches at a location disposed approximately midway between the opposite ends thereof and being provided with a radially deep annular groove confined between spaced sidewalls for sidewardly confining the lower belt reach while permitting it to undergo substantial vertical displacement.

7. An apparatus according to claim 1, wherein said belts have a round cross section.

8. An apparatus according to claim 1, wherein there are at least three said belts disposed in spaced side-by-side relationship, the upper reaches of each adjacent pair of said belts moving at different speeds, the belts being uniformly sidewardly spaced apart to define a substantially uniform clearance between each adjacent pair of belts, and the vibration means effecting vertical vibration of the upper belt reach of one belt relative to the adjacent belt of each adjacent pair.

9. An apparatus according to claim 1, wherein there are at least five said belts disposed in spaced side-by-side relationship, said belts being uniformly sidewardly spaced apart to define a substantially uniform clearance between each adjacent pair of belts, said vibration means acting on the two outermost and the middlemost belt for effecting cyclic vertical vibration of the upper reaches thereof, said vibration means including a said end idler pulley of nonconcentric profile relative to its respective rotational axis disposed in supportive engagement with each of said outermost and middlemost belts, said plurality of belts including an intermediate belt disposed between each of said outermost belts and said middlemost belt with said intermediate belt being rotatably supported on a said end idler pulley which is rotatably concentric about its rotational axis so as to prevent vertical vibration of the upper reach of the respective intermediate belt.

10. An apparatus according to claim 1, wherein said one end idler pulley is of a substantially rectangular cross section provided with rounded corners and is rotatably supported substantially about its center.

11. An apparatus according to claim 10, wherein said one end idler pulley has width and length dimensions which extend perpendicular to one another and perpendicular relative to the rotational axis of said one end idler pulley, said length dimension being greater than the width dimension by about 25% to about 50%.

12. An apparatus accourding to claim 10, wherein the end idler pulley disposed in supportive engagement with the adjacent belt is of a circular profile supported for rotation about its center.

13. An apparatus for effecting separation of a mixture of parts, such as blow-molded plastic parts, comprising:

a housing means;

elongated separator belt means movably mounted on said housing means for effecting separation of a mixture of parts by permitting first parts to fall therethrough while supporting second parts and transporting them to a discharge location;

said separator belt means including at least five endless belts movably supported on said housing, said belts being of substantially circular cross section and having elongated upper belt reaches which extend approximately horizontally of the housing means, said upper belt reaches extending in approximately parallel and adjacent side-by-side relationship and being provided with small but uniform predetermined clearance spaces between adjacent pairs of said belts for permitting said first parts to pass downwardly between said adjacent belts;

drive means for moving said belts relative to said housing means and for causing one belt of each adjacent pair to move at a speed which is slightly greater than the speed of the other belt of said adjacent pair, said drive means including drive pulley means engaging said belts adjacent one end thereof, said drive pulley means including first and second drive pulleys of different diameters; and end idler pulley means supportingly engaging said plurality of belts adjacent the other end thereof for causing the upper reaches of said plurality of belts to extend approximately horizontally of said housing means, said end idler pulley means including a plurality of individual end idler pulleys which are individually rotatably supported about a common axis and are disposed for supportive engagement with a respective one of said belts, each adjacent pair of said end idler pulleys being provided with exterior belt-engaging profiles which cause the upper reach of one of the belts of each adjacent pair to be cyclically vertically vibrated in an up-and-down manner so as to be moved vertically relative to the upper reach of the adjacent belt of said pair.

14. An apparatus according to claim 13, wherein the end idler pulley which supportingly engages the one belt of said pair has a noncircular belt-engaging profile relative to its rotational axis for causing cyclic vertical displacement of the upper reach of said one belt, and wherein the end idler pulley which supportingly engages the adjacent belt of said pair has a circular belt-engaging profile relative to its rotational axis so as to impose no cyclic vertical vibration of the upper reach of said adjacent belt.

15. An apparatus for effecting separation of a mixture of parts, such as blow-molded plastic parts, comprising:

a housing means;

elongated separator belt means movably mounted on said housing means for effecting separation of a mixture of parts by permitting first parts to fall therethrough while supporting second parts and transporting them to a discharge location;

said separator belt means including at least five endless belts movable supported on said housing, said belts being of substantially circular cross section and having elongated upper belt reaches which extend approximately horizontally of the housing means, said upper belt reaches extending in approximately parallel and adjacent side-by-side relationship and being provided with small but uniform predetermined clearance spaces between adjacent pairs of said belts for permitting said first parts to pass downwardly between said adjacent belts;

drive means for moving said belts relative to said housing means and for causing one belt of each adjacent pair to move at a speed which is slightly greater than the speed of the other belt of said pair, said drive means including drive pulley means engaging said belts adjacent one end thereof, said drive pulley means including first and second drive pulleys of different diameters; and end idler pulley means supportingly engaging said plurality of belts adjacent the other end thereof for causing the upper reaches of said plurality of belts to extend approximately horizontally of said housing means, said end idler pulley means including a plurality of individual end idler pulleys which are individually rotatably supported about a common axis and are disposed for supportive engagement with a respective one of said belts; and vibratory means disposed in engagement with alternate belts of said plurality for effecting cyclic vertical displacement of the upper reaches of the alternate belts, said vibratory means being formed as an integral part of alternate ones of said end idler pulleys with the alternate end idler pulleys being provided with a surrounding belt-engaging profile which is noncircular relative to its rotational axis for causing cyclic vertical displacement of the upper reach of the respective belt, the intermediate belts being free of vertically imposed vibration.

* * * * *